US007911195B2

(12) United States Patent
Draxelmayr

(10) Patent No.: US 7,911,195 B2
(45) Date of Patent: Mar. 22, 2011

(54) ELECTRONIC CIRCUITS AND METHODS FOR STARTING UP A BANDGAP REFERENCE CIRCUIT

(75) Inventor: Dieter Draxelmayr, Villach (AT)

(73) Assignee: Infineon Technologies AG, Neubiberg (DE)

( * ) Notice: Subject to any disclaimer, the term of this patent is extended or adjusted under 35 U.S.C. 154(b) by 831 days.

(21) Appl. No.: 11/763,210

(22) Filed: Jun. 14, 2007

(65) Prior Publication Data

US 2008/0007244 A1 Jan. 10, 2008

(30) Foreign Application Priority Data

Jul. 7, 2006 (DE) ..... 10 2006 031 549

(51) Int. Cl.
*G05F 3/16* (2006.01)

(52) U.S. Cl. ..... 323/313

(58) Field of Classification Search ..... 323/313, 323/314, 315, 316, 901
See application file for complete search history.

(56) References Cited

U.S. PATENT DOCUMENTS

| | | | | |
|---|---|---|---|---|
| 5,892,381 | A * | 4/1999 | Koifman et al. | 327/198 |
| 6,384,586 | B1 * | 5/2002 | Sugawara | 323/313 |
| 6,784,652 | B1 | 8/2004 | Aude | |
| 6,842,321 | B2 * | 1/2005 | Brohlin | 361/92 |
| 7,112,947 | B2 | 9/2006 | Draxelmayr | |
| 7,224,209 | B2 * | 5/2007 | Hsu | 327/538 |
| 7,583,135 | B2 * | 9/2009 | Ashburn et al. | 327/539 |
| 7,602,236 | B2 * | 10/2009 | Jo | 327/539 |
| 7,605,577 | B2 * | 10/2009 | Chung | 323/313 |
| 7,626,374 | B2 * | 12/2009 | Haiplik | 323/313 |
| 2007/0257655 | A1 * | 11/2007 | Nguyen | 323/314 |

FOREIGN PATENT DOCUMENTS

| | | |
|---|---|---|
| DE | 10 2004 004 305 A1 | 8/2005 |
| EP | 0 645 687 A2 | 3/1995 |
| JP | 05-204480 | 8/1993 |

OTHER PUBLICATIONS

Dehghani, R., et al., "A New Low Voltage Precision CMOS Current Reference With No External Components," IEEE, Dec. 2003, pp. 928-932, IEEE Transactions on Circuits and Systems—II: Analog and Digital Signal Processing, vol. 50, No. 12.

Gromov, V., "Development of the Bandgap Voltage Reference Circuit, Featuring Dynamic-Threshold MOS Transistors (DTMOST's) in 0.13um CMOS Tehcnology.," 2 pages.

Dehghani, R., et al., "A New Voltage Precision CMOS Current Reference With No External Components," IEEE Transactions on Circuits and Systems-II: Analog and Digital Signal Processing, vol. 50, No. 12, Dec. 2003, pp. 928-932.

(Continued)

*Primary Examiner* — Adolf Berhane
(74) *Attorney, Agent, or Firm* — Slater & Matsil, L.L.P.

(57) ABSTRACT

An electronic circuit includes a bandgap reference circuit and a start-up circuit for starting up the bandgap reference circuit. The bandgap reference circuit includes at least one electric path having a semiconductor diode and a resistor connected in series with said semiconductor diode, wherein the voltage across the resistor is proportional to the absolute temperature of the semiconductor diode. The start-up circuit assists starting up the bandgap reference circuit until the voltage across the resistor reaches a preset threshold voltage, and the start-up circuit turns off automatically when the voltage across the resistor has reached the threshold voltage.

16 Claims, 4 Drawing Sheets

OTHER PUBLICATIONS

Meijer, G.C.M., et al., "A New Curvature-Corrected Bandgap Reference," IEEE Journal of Solid-State Circuits, vol. SC-17, No. 6, Dec. 1982, pp. 1139.
Vittoz, E.A., et al., "A Low-Voltage CMOS Bandgap Reference," IEEE Journal of Solid-State Circuits, vol. SC-14, No. 3, Jun. 1979, pp. 573-574.
Buck, A.E., et al., "A CMOS Bandgap Reference Without Resisitors," IEEE Journal of Solid-State Circuits, vol. 37, No. 1, Jan. 2002, pp. 81.
Giustolisi, G., et al., "A New Voltage Reference Topology based on Subthreshold MOSFETs," IEEE Solid-State Circuits Conference, Proceedings of the 28th European, 2002, pp. 391-392.
Banba, H., et al., "A CMOS Bandgap Reference Circuit with Sub-1-V Operation," IEEE Journal of Solid-State Circuits, vol. 34, No. 5. May 1999, pp. 670-671.
Ferro, M., et al. "A Floating CMOS Bandgap Voltage Reference for Differential Applications," IEEE Journal of Solid-State Circuits, vol. 24, No. 3, Jun. 1989, pp. 690-691.
Popa, C., "DTMOST Low-Voltage Reference Circuit With Logarithmic Curvature-Correction," IEEE International Semiconductor Conference, 2003, vol. 2, pp. 353, 355.
Malcovati, P., et al. "Curvature Compensated BiCMOS Bandgap with 1 V Supply Voltage," IEE Journal of Solid-State Circuits, vol. 36, 2001, 6 pages.
Nicollini, G., et al., "A CMOS Bandgap Reference for Differential Signal Processing," IEEE Journal of Solid-State Circuits, vol. 26, No. 1, Jan. 1991, pp. 41, 43.
Watanabe, H., et al., "Precision and Robust CMOS Voltage Reference Based on the Work Function Difference of Poly Si Gate," IEEE Solid-State Circuits Conference, Proceedings of the 28th European, 2002, pp. 387, 389.
Boni, Andrea, "Op-Amps and Startup Circuits for CMOS Bandgap References With Near 1-V Supply," IEEE Journal of Solid-State Circuits, Oct. 2002, pp. 1339-1343, vol. 37, No. 10, IEEE.
Annema, A-J., "Low-Power Bandgap References Featuring DTMOST's," IEEE Journal of Solid-State Circuits, vol. 34, No. 7, Jul. 1999, pp. 949-955.
Doyle, J., et al., "A CMOS Subbandgap Reference Circuit With 1-V Power Supply Voltage," IEEE Journal of Solid-State Circuits, vol. 39, No. 1, Jan. 2004, pp. 252-255.
Huijsing, J.H. (editors), et al., "Analog Circuit Design," Kluwer Academic Press, 1996, pp. 269-352.
Allen, P.E., et al., "CMOS Analog Circuit Design, 2nd Edition," Oxford University Press, New York, U.S.A., 2002, pp. 157.
Tsividis, Y.P., et al., "A CMOS Voltage Reference," IEEE Journal of Solid-State Circuits, vol. SC-13, No. 6, Dec. 1978, pp. 774-778.
Widlar, R.J., "New Developments in IC Voltage Regulators," IEEE Journal of Solid-State Circuits, vol. SC-6, No. 1, Feb. 1971, pp. 2-7.

* cited by examiner

ELECTRONIC CIRCUITS AND METHODS FOR STARTING UP A BANDGAP REFERENCE CIRCUIT

This application claims priority to German Patent Application 10 2006 031 549.9, which was filed Jul. 7, 2006, and is incorporated herein by reference.

BACKGROUND

The invention relates to electric circuits comprising a bandgap reference circuit and a start-up circuit and to methods for starting up a bandgap reference circuit.

Bandgap reference circuits are, for instance, required as voltage or current reference sources in integrated circuits, and normally need a start-up circuit in order to work reliably. Otherwise there may be the risk that the bandgap reference circuits may work at an incorrect operating point. Bandgap reference circuits, for instance, are disclosed in published German application for patent No. 10 2004 004 305 A1.

The principle of bandgap reference circuits is the following: The voltage difference between two diodes is used to generate a proportional to absolute temperature (PTAT) current in a first resistor. This current is used to generate a voltage across a second resistor. The voltage across the second resistor is added to the voltage of one of the two diodes of the bandgap reference circuit or to a further diode.

FIG. 4 shows an example of a bandgap reference circuit 1 and a conventional start-up circuit 42. This example is provided as an illustration of the general problems associated with start-up circuits for bandgap reference circuits.

In this example, the bandgap reference circuit 1 comprises an operational amplifier A1 having an inverting input 3, a non-inverting input 4 and an output 5. The operational amplifier A1 in this example is not an ideal operational amplifier but what is known as an OTA. An OTA is a voltage-controlled current source. The output 5 of the operational amplifier A1 supplies a voltage that is applied to the gate terminals of a first PMOS transistor P1 and a second PMOS transistor P2 to form a closed control loop. A supply voltage VDD is applied to the PMOS transistors P1, P2.

The first PMOS transistor P1 is connected to the inverting input 3 of the operational amplifier A1, to a first diode D1 and to a first resistor R1. The terminals of the first diode D1 and of the first resistor R1 that are on the opposite side from the first PMOS transistor P1 are connected to ground. The node resulting from the connection of the first PMOS transistor P1 to the first resistor R1 and the first diode D1 is denoted by B1.

The second PMOS transistor P2 is connected to the non-inverting input 4 of the operational amplifier A1, to a second resistor R2 and to a third resistor R3. The terminal of the third resistor R3 on the opposite side from the second PMOS transistor P2 is connected to a first terminal of a second diode D2, whose second terminal is connected to ground. The terminal of the second resistor R2 on the opposite side from the second PMOS transistor P2 is also connected to ground. The node resulting from the connection of the second PMOS transistor P2 to the second and third resistors R2, R3 is denoted by B2.

The bandgap reference circuit 1 also comprises an output transistor P3, to which the output voltage Vout of the bandgap reference circuit 1 is applied at an output node BGout of the bandgap reference circuit 1 and across an output resistor Rout connected to ground and the output node BGout.

The gate terminal of the output transistor P3 is also connected to the gate terminals of the two PMOS transistors P1, P2. This connection forms a node BIAP.

In many cases, the operational amplifier A1 draws its bias current from the bandgap reference circuit 1 itself, for instance, by means of an additional current mirror, so that the operational amplifier A1 is also not fully functional until the bandgap reference circuit 1 has started up. The required bias current can also be generated independently of the bandgap reference circuit 1, and has a reasonably well known magnitude.

The conventional start-up circuit 42 for the bandgap reference circuit 1, provided for illustrating the general problem, comprises a PMOS transistor P4, a first NMOS transistor N1 and a second NMOS transistor N2.

The conventional start-up circuit 42 for the bandgap reference circuit 1 works as follows.

If the output voltage Vout of the bandgap reference circuit 1 has not yet reached a certain level, i.e., the bandgap reference circuit 1 has not yet started up, then an auxiliary circuit comprising the PMOS transistor P4 of the start-up circuit 42 and the first NMOS transistor N1 switches on the second NMOS transistor N2. The second NMOS transistor N2 pulls the node BIAP downwards so that an electric current begins to flow in the heart of the bandgap circuit, i.e., inside the bandgap reference circuit 1. The operational amplifier A1 should then assume full control of the bandgap reference circuit 1 at this point in time. Without this start-up assistance, the two inputs 3, 4 of the operational amplifier A1 could sit at ground potential, and the operational amplifier A1 would have no reason to change its state.

If there is sufficient electrical current flow in the heart or core of the bandgap circuit and hence the output voltage Vout at the output node BGout of the bandgap reference circuit 1 is sufficiently high, then the second NMOS transistor N2 of the start-up circuit 42 can be turned off again, so that the bandgap reference circuit 1 is brought automatically into its correct operating point by the operational amplifier A1.

Assuming that the operational amplifier A1 has a non-negligible offset voltage in the negative direction, i.e., the non-inverting input 4 of the operational amplifier A1 must be taken in the negative direction in order to bring its output 5 into the center position, and assuming that the start-up circuit 42 is just being operated at a preliminary operating point, then a "moderate" electrical current flows in the bandgap reference circuit 1. Then the two inputs 3, 4 of the operational amplifier A1 are also taken to a "moderate" start-up state. In this case, it may happen that the general conditions are inadequate for sensible operation of the operational amplifier A1.

If, nonetheless, sensible operation of the operational amplifier A1 of the bandgap reference circuit 1 is possible, then it is conceivable that the operational amplifier A1 is controlling in the wrong direction: if the electrical current within the bandgap reference circuit 1 is not large enough, and hence the electrical voltages across the resistors R1, R2, R3 are not large enough for a non-negligible electrical current to flow through the two diodes D1, D2, then the inputs 3, 4 of the operational amplifier A1 are also driven at a negligible level. Assuming the aforementioned offset voltage of the operational amplifier A1, the operational amplifier then controls in the wrong direction, i.e., the operational amplifier A1 of the bandgap reference circuit 1 tries to reduce the electrical current inside the bandgap reference circuit 1. If, however, the start-up circuit 42 has already reached a start-up state at which it would like to turn off, it is evident that the bandgap reference circuit 1 may never reach its required operating point. In fact to reach this operating point it would require a sufficient electrical current to flow through the two diodes D1, D2, so that the operational amplifier A1 is driven beyond its own offset voltage. Only then will the automatic control work satisfactorily.

The turn-off point of the conventional start-up circuit 42 is hence relatively critical. In particular, for relatively low supply voltages and output voltages and relatively low temperatures, the conditions described above may be so unfavorable that it becomes impossible to design the start-up circuit 42 using sensible component values.

SUMMARY OF THE INVENTION

In one aspect of the invention, an electronic circuit comprises a bandgap reference circuit which comprises at least one diode path comprising a semiconductor diode, wherein the diode path comprises a resistor connected in series with the semiconductor diode, and the voltage across the resistor is proportional to the absolute temperature of the semiconductor diode, and a start-up circuit for starting up the bandgap reference circuit, which assists the start-up of the bandgap reference circuit until the voltage across the resistor reaches a preset threshold voltage and turns off automatically when the voltage across the resistor has reached the threshold voltage.

Bandgap reference circuits are generally known, for instance, from P. E. Allen, D. R. Holberg, "CMOS Analog Circuit Design," 2nd edition, Oxford University Press, New York, USA 2002, page 157; J. H. Huijsing et al., (Editor), "Analog Circuit Designs," Kluwer Academic Press, 1996, pages 269-350; A. Annema, "Low-Power Bandgap Reference Featuring DTMOSTs," IEEE Journal of Solid-State Circuits, Vol. 34, No. 7, July 1999, pages 949-952, R. J. Widlar, "New Developments in IC Voltage Regulators," IEEE Journal of Solid-State Circuits, Vol. SC-6, No. 1, February 1971, page 2 et seq; Tsividis, "A CMOS Voltage Reference," IEEE Journal of Solid-State Circuits, Vol. SC-13, No. 6, December 1978, page 774 et seq; and Doyle, "A CMOS Subbandgap Reference Circuit With 1-V Power Supply Voltage,"IEEE Journal of Solid-State Circuits, Vol. 39, No. 1, January 2004, page 252 et seq. They comprise, for instance, two diode paths, each of which comprises a semiconductor diode. Conventional diodes, for instance, can be used as semiconductor diodes, as is the case in the bandgap reference circuit 1 described above. The term semiconductor diode, however, is used here not only for conventional diodes but generally for semiconductors having diode properties, such as transistors. Transistors useful for bandgap reference circuits may be vertical bipolar transistors, for instance, or MOSFETs operated in the sub-threshold region for example.

Bandgap reference circuits can supply a reference voltage at their outputs, as is the case for the bandgap reference circuit 1 described in the introduction. Bandgap reference circuits can also supply a reference current.

According to an embodiment of the invention electric circuit, the criterion for turning off the start-up circuit is the voltage across the resistor, with the resistor being connected in series with the semiconductor diode of the bandgap reference circuit. The voltage across the resistor is proportional to the absolute temperature of the semiconductor diode. Once the bandgap reference circuit has started up, a sufficiently large electrical current flows within the bandgap reference circuit for the voltage across this resistor to reach the threshold voltage.

In another aspect of the invention, an electronic circuit comprises a bandgap reference circuit and a start-up circuit for starting up the bandgap reference circuit, which assists the start-up of the bandgap reference circuit until a difference voltage between a potential of a node within the bandgap reference circuit and another node of the bandgap reference circuit, which is at a potential proportional to an output voltage or an output current of the bandgap reference circuit, reaches a preset threshold voltage and turns off automatically when the difference voltage has reached the threshold voltage.

The turn-off criterion for this embodiment of the inventive electronic circuit is the attainment of a preset difference voltage, for instance, generated by the differential amplifier of the start-up circuit. The difference voltage is obtained from the potential of the node within the bandgap reference circuit and a potential of the other node of the bandgap reference circuit, which is at a potential proportional to the output voltage or the output current of the bandgap reference circuit.

The node within the bandgap reference circuit is in particular a node within a diode path of the bandgap reference circuit, wherein the diode path comprises a semiconductor diode. If the bandgap reference circuit comprises two diode paths, each comprising a diode semiconductor, then the potential at the node within the bandgap reference circuit may also be a mean value of the potentials of two nodes within the bandgap reference circuit.

In another aspect of the invention, a method for starting up a bandgap reference circuit comprises assisting the start-up of a bandgap reference circuit by means of a start-up circuit, wherein the bandgap reference circuit comprises at least one diode path comprising a semiconductor diode and a resistor connected in series with the semiconductor diode. The voltage across the resistor is proportional to the absolute temperature of the semiconductor diode and the start-up circuit assists the start-up of the bandgap reference circuit while the voltage across the resistor within the bandgap reference circuit is less than a preset threshold voltage. The method further comprises automatically turning off the start-up circuit when the voltage across the resistor has reached the threshold voltage.

In a further aspect of the invention, a method for starting up a bandgap reference circuit comprises assisting the start-up of a bandgap reference circuit by means of a start-up circuit, wherein the bandgap reference circuit comprises a diode path comprising a semiconductor diodes. The start-up circuit assists the start-up of the bandgap reference circuit while a difference voltage between a potential of a node within the diode path and another node of the bandgap reference circuit, which is at a potential proportional to an output voltage or an output current of the bandgap reference circuit, is less than a preset threshold voltage. The method further comprises automatically turning off the start-up circuit when the difference voltage has reached the threshold voltage.

The difference voltage can, for instance, be monitored or generated by a differential amplifier. If the bandgap reference circuit comprises two diode paths, each comprising one semiconductor diode, then the potential at the node within the bandgap reference circuit may also be a mean value of the potentials of two nodes within the bandgap reference circuit.

The invention also provides a method for operating a start-up circuit for a bandgap reference circuit, wherein the criterion for turning off the start-up circuit is the attainment of a preset voltage across a resistor connected in series with a semiconductor diode of the bandgap reference circuit, wherein the voltage across the resistor is proportional to the absolute temperature of the semiconductor diode, or the criterion for turning off the start-up circuit is the attainment of a preset difference voltage, which is between a potential of a node within the bandgap reference circuit and another node, which is at a potential proportional to the output voltage or proportional to the output current of the bandgap reference circuit.

The semiconductor diode of the bandgap reference circuit may be a conventional diode, for instance, as is the case in the bandgap reference circuit 1 described above. The term semiconductor diode, however, is used here not only for conventional diodes but generally for semiconductors having diode properties, such as, for instance, transistors. Transistors useful for a bandgap reference circuit may be vertical bipolar transistors or MOSFETs operated in the sub-threshold region, for example.

Bandgap reference circuits can supply a reference voltage at their output, as is the case in the bandgap reference circuit 1 described in the background. Bandgap reference circuits may also supply a reference current, however.

DETAILED DESCRIPTION OF ILLUSTRATIVE EMBODIMENTS

Figure 4:
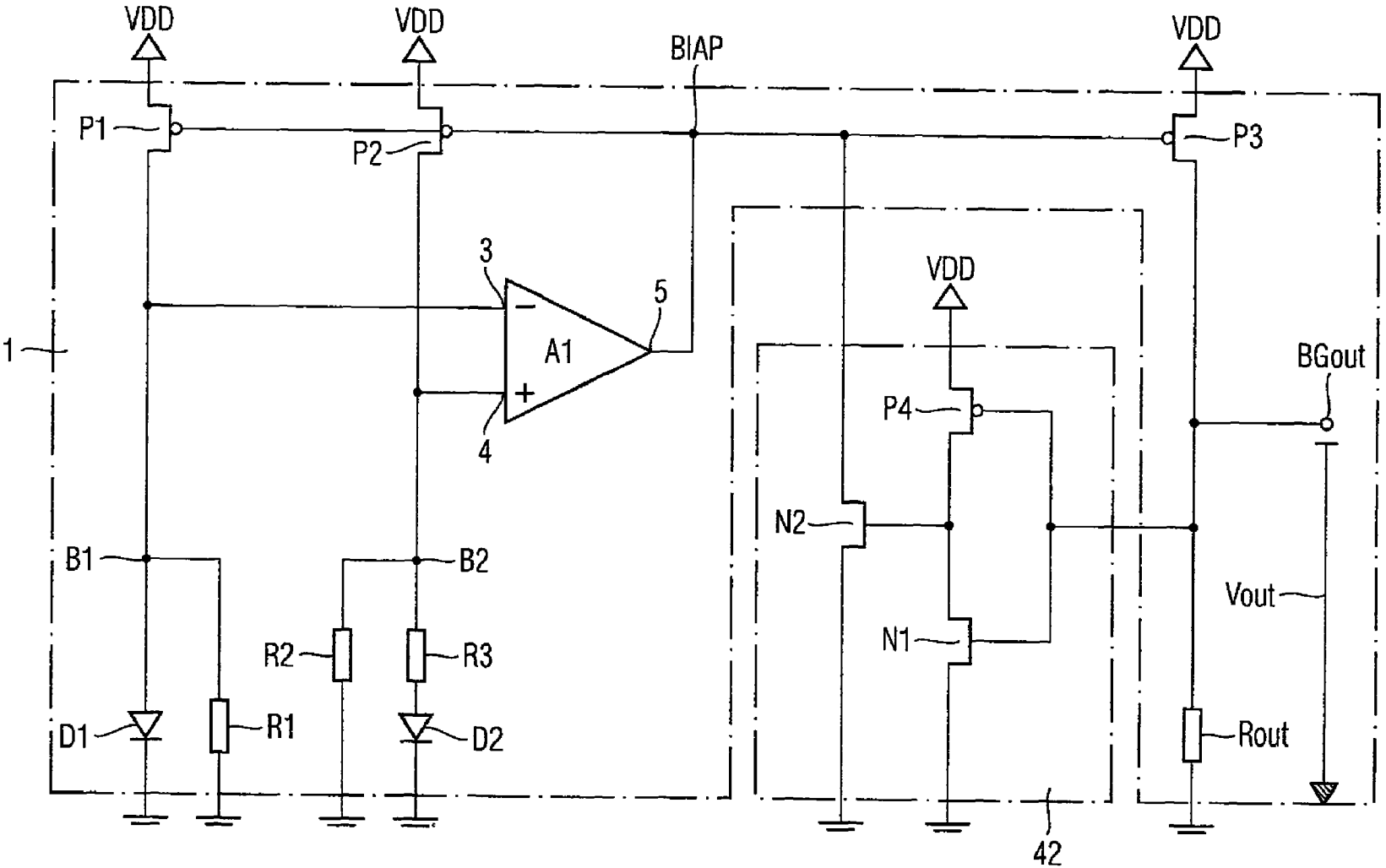
FIG. 4 is a bandgap reference circuit including a conventional start-up circuit.

FIG. 4 has been discussed in the background section.

Figure 1:
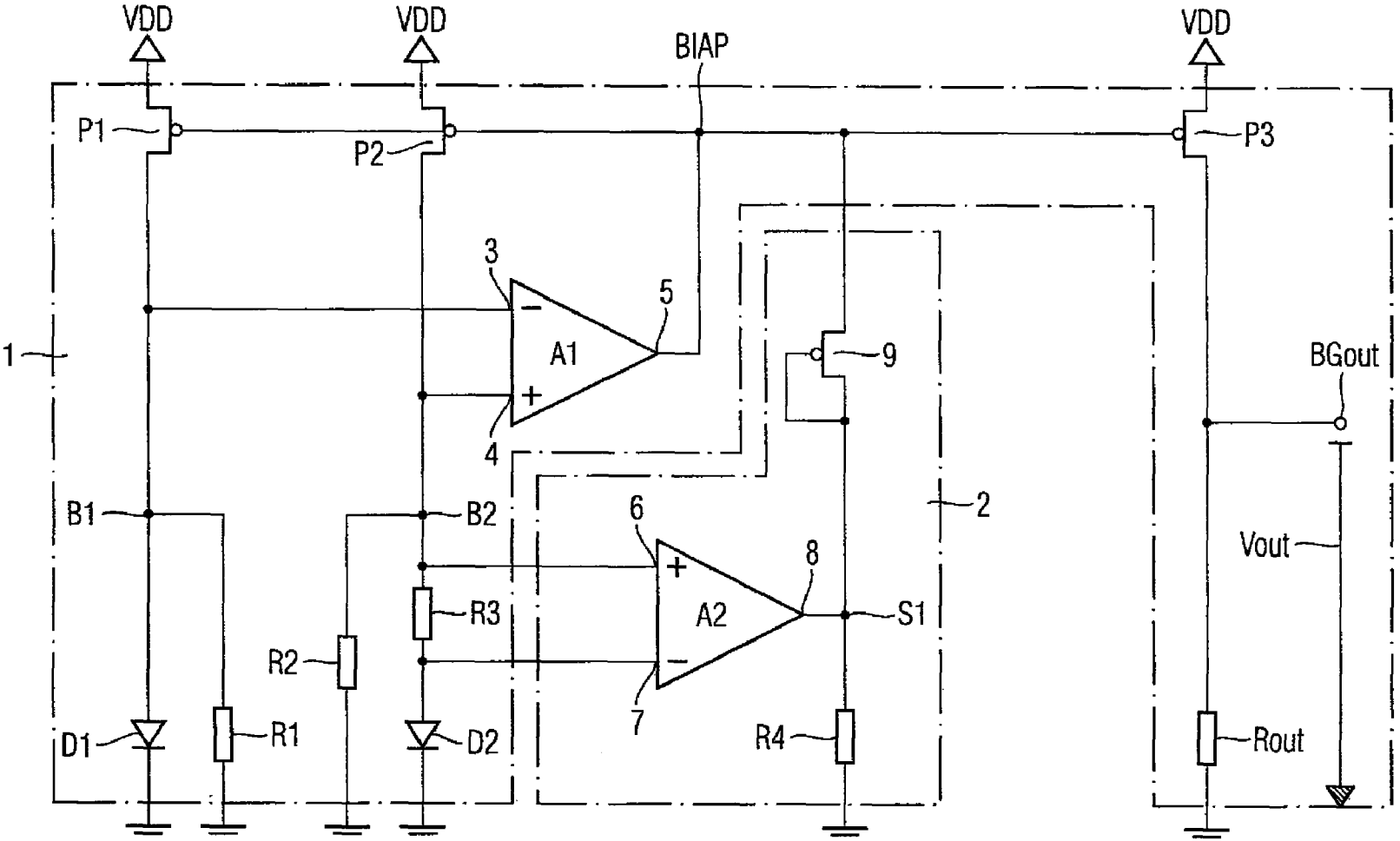
FIG. 1 is a bandgap reference circuit including a first exemplary embodiment of a start-up circuit.

FIG. 1 shows the bandgap reference circuit 1 already described in the background, and a first exemplary embodiment of a start-up circuit 2 for the bandgap reference circuit 1.

In this exemplary embodiment, the start-up circuit 2 comprises an operational amplifier A2 comprising a non-inverting input 6, an inverting input 7 and an output 8, plus a resistor R4 and a MOS diode 9. The operational amplifier A2 in this exemplary embodiment is again in this case a non-ideal operational amplifier, and once again is an OTA. An OTA is a voltage-controlled current source.

The resistor R4 of the start-up circuit 2 is connected by one of its terminals to the output 8 of the operational amplifier A2 and to one of the terminals of the MOS diode 9. The other terminal of the resistor R4 is connected to ground, and the second terminal of the MOS diode 9 is connected to the node BIAP.

The two inputs 6, 7 of the operational amplifier A2 of the start-up circuit 2 are connected to the respective two terminals of the third resistor R3 of the bandgap reference circuit 1, so that the voltage across the third resistor R3 is applied to the inputs 6, 7 of the operational amplifier A2 of the start-up circuit 2. The voltage across the third resistor R3 is proportional to the absolute temperature of the second diode D2.

If the bandgap reference circuit 1 has still not reached a sufficient start-up state, then a relatively low electrical current flows through the third resistor R3. This means that the operational amplifier A2 is driven at a relatively low level, so that the operational amplifier A1 is also driven at a relatively low level, because, assuming the electrical currents through the two diodes D1, D2 are negligible, the two nodes B1, B2 are at the same potential. Thus the two operational amplifiers A1, A2 supply only relatively small output currents, so that the node BIAP is enabled via the resistor R4 of the start-up circuit 2 and the MOS diode 9.

In order to turn off the MOS diode 9, a non-negligible voltage drop across the third resistor R3 of the bandgap reference circuit 1 is required; in the present exemplary embodiment a voltage drop of 10 mV is required. Only once this voltage drop across the third resistor R3 is reached does the operational amplifier A2 of the start-up circuit 2 supply a sufficiently large electrical current for the electrical potential at the node S1, which is formed by the connection of the output 8 of the operational amplifier A2, the MOS diode 9 and the resistor R4 of the start-up circuit 2, to be at such a level that the MOS diode 9 is reverse biased, and the start-up circuit 2 thereby turns itself off automatically.

The bandgap reference circuit 1 can consequently be designed using component values lying within a far larger range than is possible with the conventional start-up circuit 42 shown in FIG. 4.

The closed loop via the operational amplifier A1 of the bandgap reference circuit 1 works correctly when the offset voltage at the inputs 3, 4 of the operational amplifier A1 is surmounted. This is typically the case for a relatively low mV level. It is desirable if the start-up circuit 2 turns off reliably when the bandgap reference circuit 1 has reached its final operating point. For the exemplary embodiment, this is the case for several tens of millivolts, for instance, 50 mV. Thus a relatively wide range is obtained within which the turn-off threshold of the start-up circuit 2 can lie.

Figure 2:
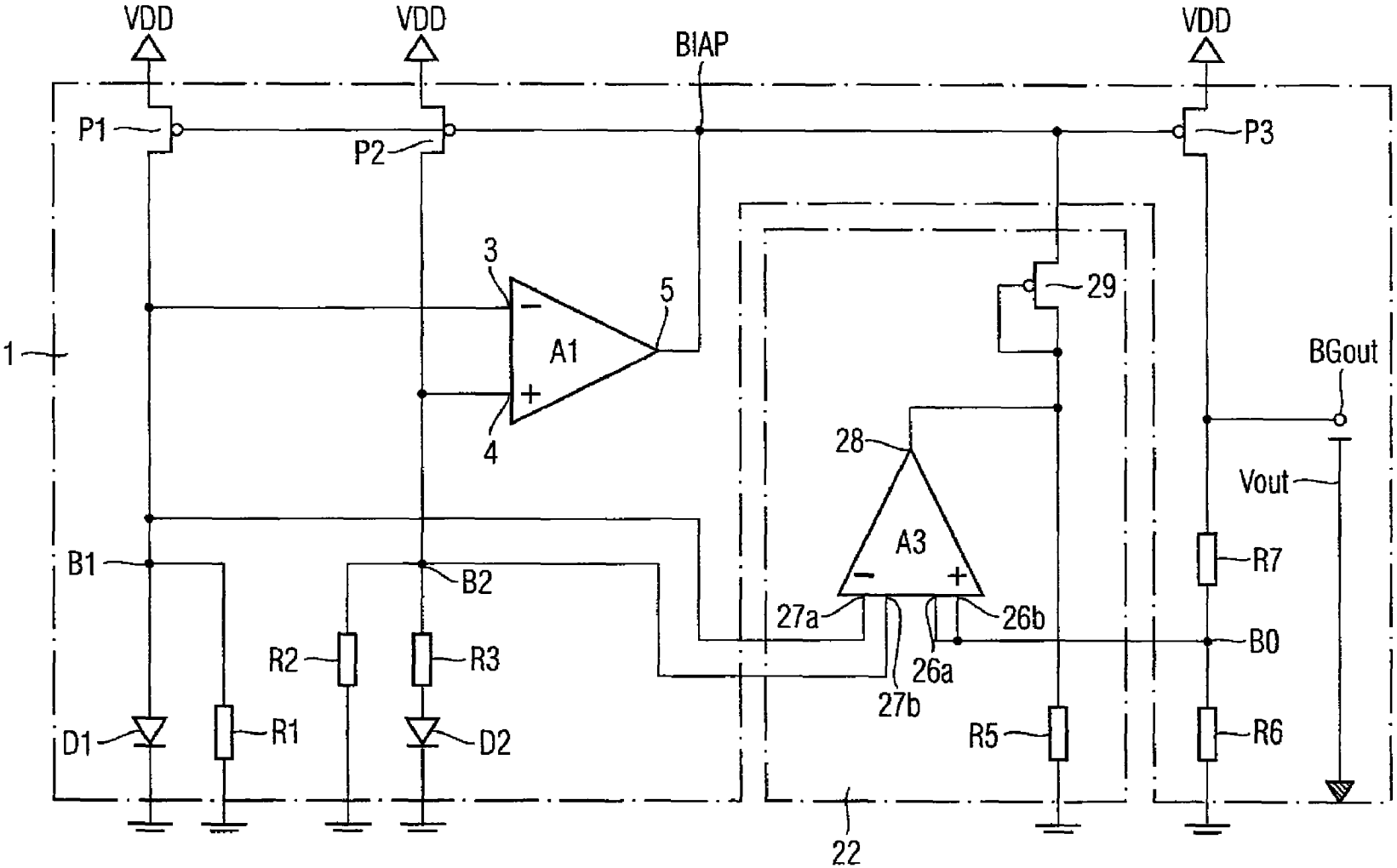
FIG. 2 is a bandgap reference circuit including a second exemplary embodiment of a start-up circuit.

FIG. 2 shows another embodiment of a circuit 22 for the bandgap reference circuit 1. The start-up circuit 22 comprises a differential amplifier A3 comprising two inverting inputs 27*a*, 27*b*, two non-inverting inputs 26*a*, 26*b* connected together, and an output 28, plus a resistor R5, which is connected to ground by its one terminal and to the output 28 of the differential amplifier A3 by its other terminal, and a MOS diode 29, which is connected on one side to the output 28 of the differential amplifier A3 and on the other side to the node BIAP.

The first inverting input 27*a* is connected to the node B1, and the second inverting input 27*b* is connected to the node B2. The two non-inverting inputs 26*a*, 26*b* are connected to a node B0. The node B0 is part of a potential divider comprising a resistor R6 and a resistor R7. The two resistors R6, R7 form the output resistance Rout (FIG. 1), so that at the node B0 there is a voltage proportional to the output voltage Vout of the bandgap reference circuit 1.

The differential amplifier A3 of the start-up circuit 22 thereby compares the voltage drop across the first and second resistors R1, R2 with the voltage at the node B0, i.e. with a scaled version of the output voltage Vout of the bandgap reference circuit 1.

Figure 3:
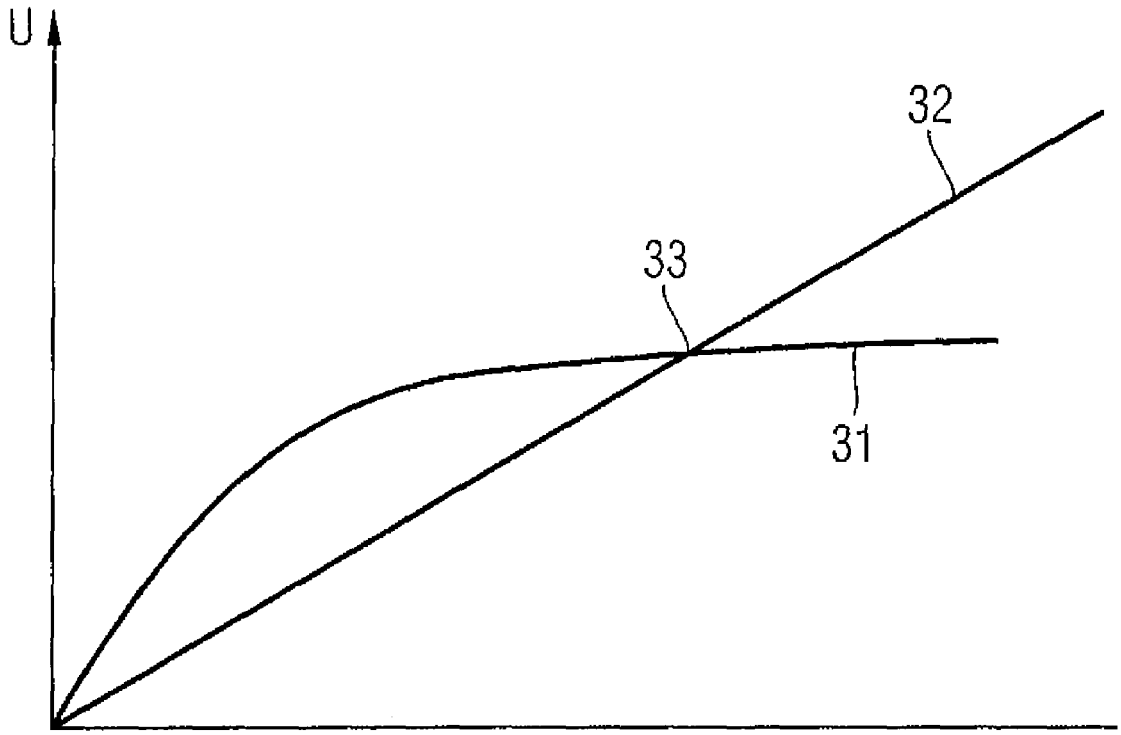
FIG. 3 is a graph illustrating how the start-up circuit of FIG. 2 works.

A graph shown in FIG. 3 is used to illustrate how the start-up circuit 22 works. The graph of FIG. 3 shows the voltage curve 31 at the nodes B1, B2 and the voltage curve 32 at the node B0 plotted against an electrical current supplied to the two PMOS transistors P1, P2. The voltage curve 32 at the node B0 is linear. The voltage curve at the nodes B1, B2 is initially approximately linear, before the voltage 31 flattens off as the two diodes D1, D2 conduct. Consequently, by monitoring the intersection point 33 of the two voltages 31, 32, one can establish extremely well whether the diode paths comprising the two diodes D1, D2 are already passing a sufficiently large electrical current. The differential amplifier A3 now monitors precisely this criterion and switches off the start-up circuit 22 when it is clearly exceeded.

The differential amplifier A3 having its two inverting inputs 27*a*, 27*b* and its two non-inverting inputs 26*a*, 26*b* respectively is intended to suggest an averaging process in each case. In the present exemplary embodiment, this is implemented in circuitry by two transistors being connected in parallel with a differential input stage in each case. The reason for this lies in the relatively equal loading of the nodes B1, B2, for example by gate leakage currents. Alternatively, a conventional amplifier solution can also be chosen, for instance, by comparison of the voltages at the nodes B1, B0.

The start-up circuit 22 shown in FIG. 2 can also supply a start-up current without the resistor R5. In this case, however, it must be taken into account that when the bandgap reference circuit 1 is completely turned off, the differential amplifier A3 would supply no current, and hence a dedicated start-up circuit for this point would be required.

The claimed start-up circuit for a bandgap reference circuit 1 and the claimed method for starting up a bandgap reference circuit, and the start-up circuits 2, 22 shown in FIGS. 1 and 2, respectively, are not restricted to the bandgap reference circuit 1 shown. In particular, instead of the two diodes D1, D2, transistors can also be used, for instance, vertical bipolar transistors or MOSFETs, for instance, in the sub-threshold region. In addition, the first and second resistors R1, R2 are not absolutely necessary.

In particular, it is also possible that the mean value of the potentials at the nodes B1 and B2 is not used for the difference voltage of the electronic circuit shown in FIG. 2, but just one of the potentials of the nodes B1 or B2. In addition, the potential at the terminal of the resistor R3 connected to the diode D2 can be used instead of the potential at the node B2.

Although modifications and changes may be suggested by those skilled in the art, it is the intention of the inventor to embody within the patent warranted hereon all changes and modifications as reasonably and properly come within the scope of his contribution to the art.

What is claimed is:

1. An electronic circuit comprising a bandgap reference circuit comprising at least one electric path comprising a semiconductor diode and a resistor coupled in series with said semiconductor diode, a voltage across said resistor being proportional to an absolute temperature of said semiconductor diode; and a start-up circuit for starting up said bandgap reference circuit, said start-up circuit assisting starting up said bandgap reference circuit until said voltage across said resistor reaches a preset threshold voltage and turning off automatically when said voltage across said resistor has reached said preset threshold voltage.

2. The electronic circuit of claim 1, wherein said bandgap reference circuit is a bandgap voltage reference circuit or a bandgap current reference circuit.

3. The electronic circuit of claim 1, wherein said bandgap reference circuit comprises two electric paths, each electric path comprising a semiconductor diode.

4. An electronic circuit comprising:

a bandgap reference circuit comprising at least one electric path comprising a semiconductor diode; and a start-up circuit for starting up said bandgap reference circuit, said start-up circuit assisting starting up said bandgap reference circuit until a difference voltage between a potential of a first node within said bandgap reference circuit and a second node, which is at an electric potential proportional to an output voltage or an output current of said bandgap reference circuit, reaches a preset threshold voltage, and said start-up circuit turning off automatically when said difference voltage has reached the preset threshold voltage.

5. The electronic circuit of claim 4, wherein said start-up circuit comprises a differential amplifier for monitoring said difference voltage.

6. The electronic circuit of claim 4, wherein said start-up circuit comprises a differential amplifier for generating said difference voltage.

7. The electronic circuit of claim 4, wherein said bandgap reference circuit is a bandgap voltage reference circuit or a bandgap current reference circuit.

8. The electronic circuit of claim 4, wherein said bandgap reference circuit comprises two electric paths, each electric path comprising a semiconductor diode.

9. A method for starting up a bandgap reference circuit, the method comprising:

assisting a start-up of a bandgap reference circuit by using a start-up circuit, wherein said bandgap reference circuit comprises at least one electric path comprising a semiconductor diode and a resistor coupled in series with said semiconductor diode, a voltage across said resistor being proportional to an absolute temperature of said semiconductor diode, and said start-up circuit assisting starting up said bandgap reference circuit while said voltage across said resistor within said bandgap reference circuit is less than a preset threshold voltage; and automatically turning off said start-up circuit when said voltage across said resistor has reached said preset threshold voltage.

10. The method of claim 9, wherein said bandgap reference circuit comprises two electric paths, each electric path comprising a semiconductor diode.

11. The method of claim 9, wherein said bandgap reference circuit is a bandgap voltage reference circuit or a bandgap current reference circuit.

12. A method for starting up a bandgap reference circuit, the method comprising:

assisting starting-up a bandgap reference circuit by using means-of a start-up circuit, wherein said bandgap reference circuit comprises an electric path comprising a semiconductor diode, said start-up circuit assisting starting-up said bandgap reference circuit while a difference voltage between a potential of a first node within said electric path and a second node is less than a preset threshold voltage, said second node being at a potential proportional to an output voltage or an output current of said bandgap reference circuit; and automatically turning off said start-up circuit when said difference voltage has reached said preset threshold voltage.

13. The method of claim 12, further comprising monitoring said difference voltage utilizing a differential amplifier.

14. The method of claim 12, further comprising generating said difference voltage utilizing a differential amplifier.

15. The method of claim 12, wherein said bandgap reference circuit comprises two electric paths, each electric path comprising a semiconductor diode.

16. The method of claim 12, wherein said bandgap reference circuit is a bandgap voltage reference circuit or a bandgap current reference circuit.

* * * * *